United States Patent [19]

Weber

[11] Patent Number: 4,841,424

[45] Date of Patent: Jun. 20, 1989

[54] KNOCKDOWN RING FRAME FOR LAMP SHADE

[75] Inventor: Franz K. Weber, Belmont Shore, Calif.

[73] Assignee: Modulite Corporation, Compton, Calif.

[21] Appl. No.: 200,546

[22] Filed: May 31, 1988

[51] Int. Cl.[4] ..... F21V 1/06

[52] U.S. Cl. ..... 362/352; 362/358; 362/450

[58] Field of Search ..... 362/352, 358, 434, 440, 362/449, 450

[56] References Cited

U.S. PATENT DOCUMENTS 4,625,268 11/1986 Payne ..... 362/352
4,688,155 8/1987 Huang ..... 362/352
4,751,625 6/1988 Lin ..... 362/352 X

FOREIGN PATENT DOCUMENTS 438698 8/1948 Italy ..... 362/358

*Primary Examiner*—Stephen F. Husar
*Attorney, Agent, or Firm*—Gene W. Arant; Don C. Lawrence

[57] ABSTRACT

A ring-shaped brace or frame for supporting the ribs of a knockdown-style lamp shade includes a plurality of rigid, elongated members which are formed to lie in a plane and interconnect end-to-end to form a rigid, closed polyagonal ring. Means are provided which receive ends of adjacent members and connect them in rigid, snap-together, pull-apart, locking engagement. Because the ring frame is quickly and easily assembled or disassembled by the consumer without the use of tools, it can be packed, along with the shade, in a compact, disassembled condition for shipment and sale.

12 Claims, 3 Drawing Sheets

Fig. 1.
PRIOR ART
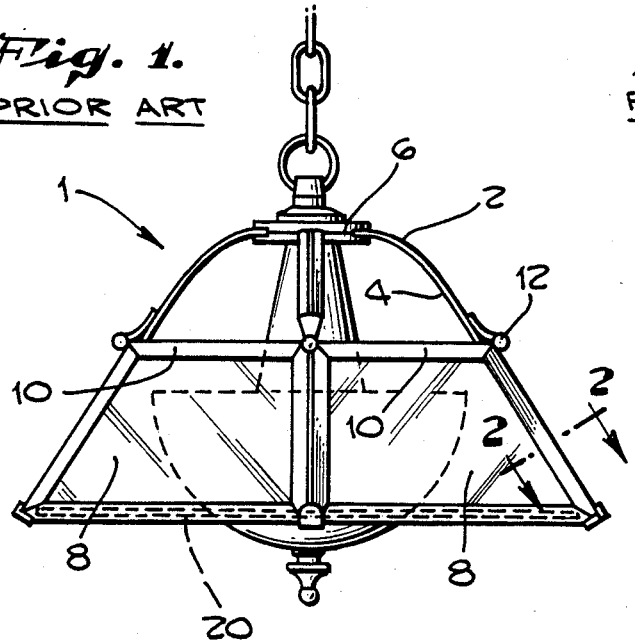
Fig. 2.
PRIOR ART
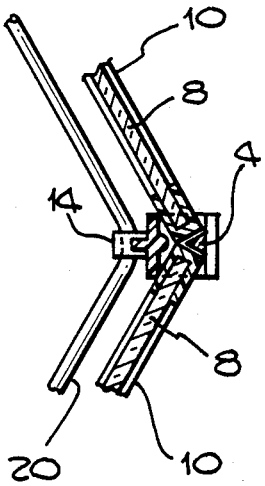
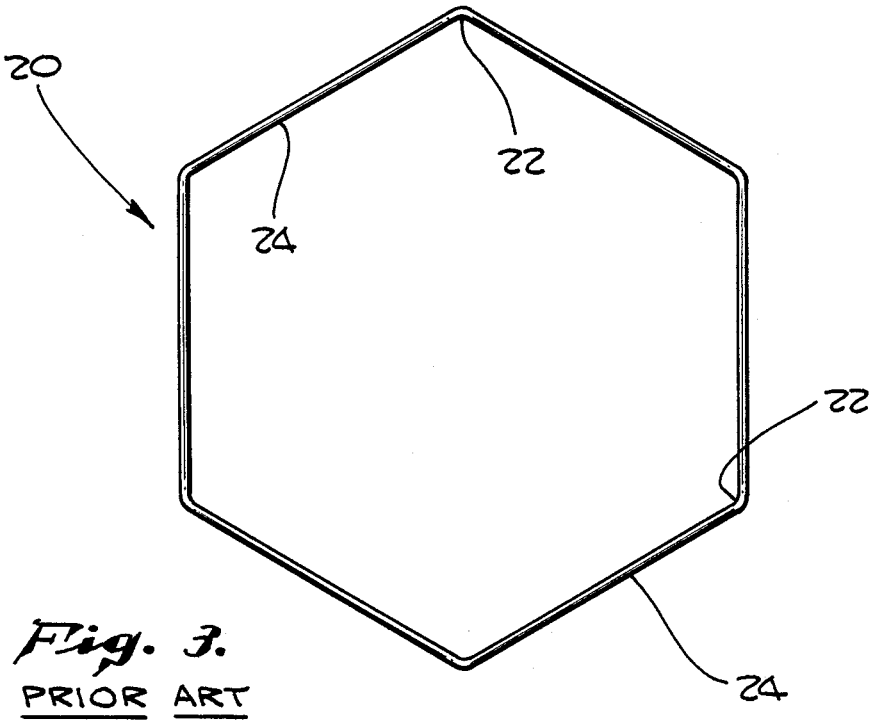
Fig. 3.
PRIOR ART

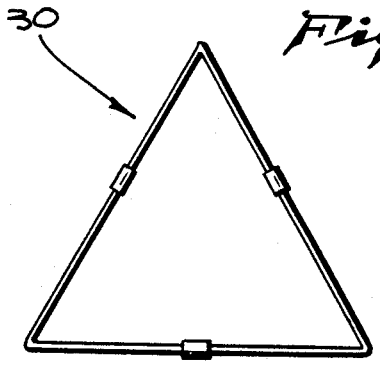
Fig. 9.
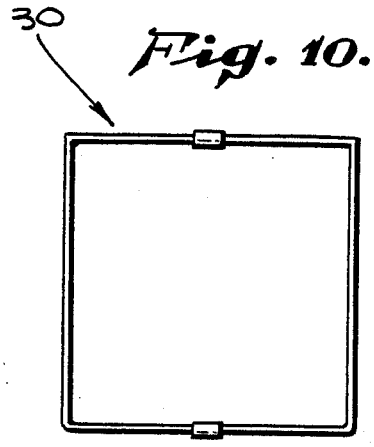
Fig. 10.
Fig. 11.
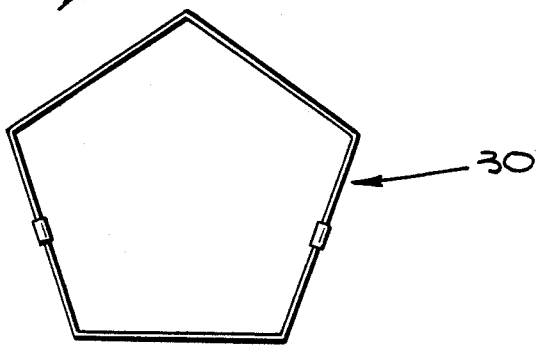
Fig. 12.
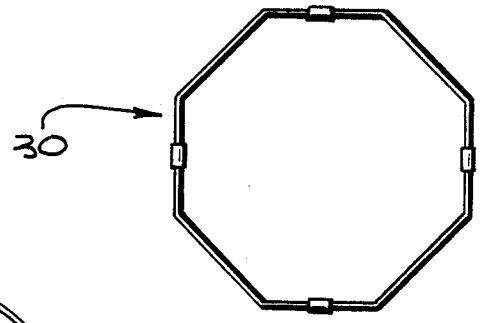
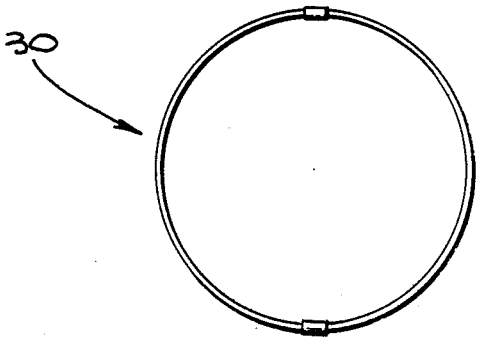
Fig. 13.

KNOCKDOWN RING FRAME FOR LAMP SHADE

BACKGROUND OF THE INVENTION

1. Field of the Invention

This invention pertains, in general, to lighting fixtures, and in particular, to a knockdown support ring for a lamp shade.

2. Description of the Related Art

In U.S. Pat. No. 4,227,822 to Weber, et al (reissued as Re. 31,798), a type of knockdown lamp shade assembly is disclosed which is relatively inexpensive and easily assembled or disassembled for storage or shipping, yet one which, when assembled, provides an attractive lighting fixture complementary to most decors.

This assembly has demonstrated satisfactory commercial success since its introduction to the market. It is believed that a large part of this success is due to its knockdown construction, which permits the fixture to be cushioned in a compact package for transport and storage, and then quickly and easily assembled for installation by either the retailer or the purchaser without tools.

A limitation on the advantages of this assembly is the size of a one of the components therein, namely, a ring frame or brace, one or more of which are used to support the ribs of the shade when it is assembled. The size of the ring frame is due to its construction, which involves forming an elongated rod into a rigid, closed, planar shape (typically hexagonal) and fusing the ends of the rod together. Because the ring frame spans the entire width of the assembled shade, its size dictates a lower bound on one of the dimensions of the container required to hold the disassembled shade. The resulting container is much larger than needed to package the balance of the assembly efficiently. It is thus desirable to reduce this dimension, thereby enabling the disassembled shade to be packaged more efficiently and compactly, while still retaining the knockdown advantages of the shade.

The present invention teaches a way to overcome this limitation and provide a knockdown lamp shade that is easily assemblable and disassemblable and which fits, when disassembled, into a much smaller container.

SUMMARY OF THE INVENTION

These objects, and others, are preferably accomplished, in a knockdown lamp shade assembly of the type discussed above, by the provision of a knockdown ring frame comprising at least two rigid, elongated rods formed to lie in a common plane and connect end-to-end with each other to form a closed ring having the desired shape, along with connector means for rigidly interconnecting the ends of the rods together in a push-together, snap-apart fashion.

In a preferred embodiment, these connector means comprise split sleeves having opposite, open ends adapted to receive the ends of adjacent rods in opposing, slide-in fashion, and a pair of lateral detents adjacent each open end to engage a corresponding lateral tongue formed on each rod end in snap-in, locking engagement.

A better understanding of the knockdown ring frame of the present invention may be had by considering the following detailed description of some preferred embodiments thereof, particularly if read in conjunction with the appended drawings, of which the following is a brief description.

BRIEF DESCRIPTION OF THE DRAWINGS

FIG. 1 illustrates a knockdown lamp shade assembly of the prior art;

FIG. 2 is a partial sectional view of the shade assembly illustrated in FIG. 1 looking into a supporting rib and a pair of windows supported thereby, as revealed by the section 2—2 taken in FIG. 1;

FIG. 3 is a plan view of a typical ring frame of a known type as utilized by the prior art shade illustrated in FIG. 1;

FIG. 9 is a plan view of a triangular embodiment of the ring frame of the present invention;

FIG. 10 is a plan view of a square embodiment of the ring frame of the present invention;

FIG. 11 is a plan view of a pentagonal embodiment of the ring frame of the present invention;

FIG. 12 is a plan view of a octagonal embodiment of the ring frame of the present invention; and FIG. 13 is a plan view of a circular embodiment of the ring frame of the present invention.

DETAILED DESCRIPTION OF THE PREFERRED EMBODIMENTS

Figure 4:
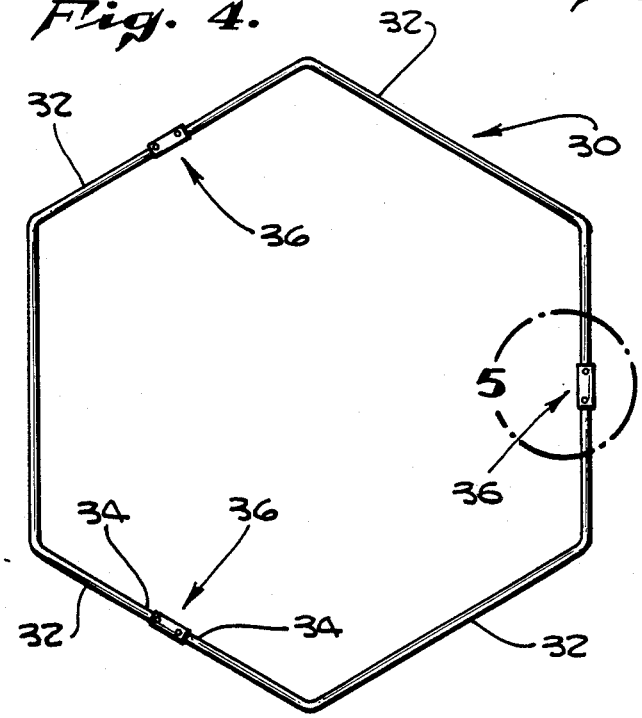
FIG. 4 is a plan view of a hexagonal embodiment of a knockdown ring frame in accordance with the present invention.

In FIG. 1, a lighting fixture 1 is illustrated which includes a knockdown shade assembly 2 of a type disclosed in U.S. Pat. No. 4,277,822 (reissued as Re. 31,798), the disclosure of which is incorporated herein by this reference.

The shade assembly 2 includes a plurality of ribs 4 which have upper ends that snap into a base member 6, from which they radiate outwardly and downwardly like the spokes of a wheel. A plurality of trapezoidal panes or windows 8, each of which is edged about its entire periphery by U-shaped pieces of trim channel 10, are arranged circumferentially around the assembly with side edges in abutment, and are supported by the ribs at each of their lower corners and side edges to face outwardly from the light. Adjacent panes are clipped to the ribs at their adjacent upper corners by means of snap-on retention finger 12.

Each of the ribs 4 includes at least one socket plate 14 on its underside at its lower end, each of which plates contains a socket adapted to receive a ring-shaped brace or frame 20 in snap-in engagement (see FIG. 2). The ring frame 20 serves to spread the ribs radially outwardly and hold them in a fixed position against the weight of the panes 8. A larger shade may include a second, smaller ring frame at the level of the upper edges of the panes to support the ribs at about the middle of their length.

FIG. 3 is a plan view of the ring frame 20 illustrated in FIGS. 1 and 2, and has a hexagonal shape to conform to the hexagonal shade 2 illustrated therein. However, it will be noted that the shade can be provided in one of several possible regular polyhedral configurations, e.g., triangular, square, pentagonal, etc., with the frame 20 shaped into a corresponding polyagonal ring to accomodate it. The frame 20 is typically formed from a single, elongated piece of bar stock material, e.g., steel, to include a number of equiangular bends 22 located between sides 24 of equal length. The ends of the rod are welded or brazed together to close the ring. When installed in the shade, the bends 22 snap into the sockets in the plates 14 on the underside of the ribs 4, with the sides 24 parallel to the lower edges of the panes 8.

It will be noted that the ring frame 20 illustrated has a span or diameter approximately equal to that of the shade 2 when it is fully assembled. Since the shade can be knocked down to a collection of significantly smaller parts for shipping or storage, the size of the ring frame represents a lower limit on the size of package needed to contain the complete shade assembly. While the frame could be stored and shipped separately, this is not considered the preferred solution, as this increases the possibility that the frame will be lost from its associated shade or that the wrong frame could be associated with it.

A solution to this problem is to be found in the ring frame 30 of the present invention, an exemplary preferred embodiment of which is illustrated in plan view in FIG. 4. The ring frame 30 comprises the subcombination of a rigid, elongated rod or member 32 which has a pair of opposite ends 34 and is formed or bent so as to lie in a plane and rigidly interconnect end-to-end with at least one other such member to form a closed planar ring. Means 36 are provided at the ends of the members in the combination to rigidly interconnect them. In the embodiment illustrated, three identical rods 32 are interconnected to form a regular hexagonal ring to replace the prior art ring 20 illustrated in FIG. 3. Each of the three rods includes a pair of 120° bends, each bend located one-fourth of the rod's length from an end 34.

It will be recognized that the hexagonal ring 30 illustrated could be made up of only two bent members connected rigidly end-to-end, where each member contains three 120° bends, one at the center and another located one-sixth the member's length in from each end. This configuration will result in fewer, but larger, parts to package and assemble. Likewise, it will be recognized that the individual rods within the ring need not all be identical, so long as the resulting ring, when assembled, forms the desired closed planar figure. However, this latter alternative is not considered preferable, as it results in more complexity and a greater number of part numbers for a given ring configuration, with attendant increased tooling and stocking costs.

Figure 5:
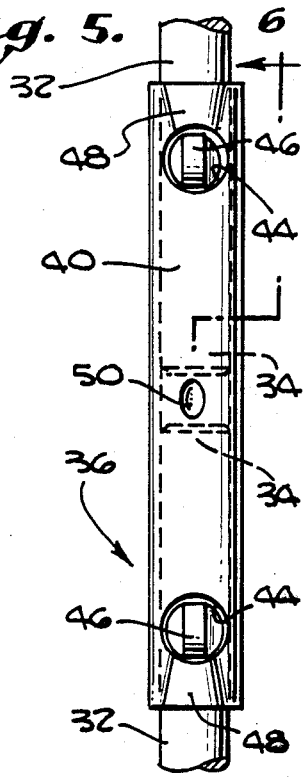
FIG. 5 is an enlarged plan view of a connector for the ring frame illustrated in FIG. 4, as revealed by enlarging the detail 5 taken therein.

The preferred means 36 for rigidly interconnecting the members 32 end-to-end within the ring 30 are illustrated in enlarged detail in FIG. 5, and comprise an open-ended sleeve or tube 40 which contains an open seam 42 along one side throughout its length to permit it to spring open and closed radially. In the exemplary embodiment illustrated, the rods 32 are cylindrical in cross section, and the connector sleeves 40 are internally cylindrical to accomodate the ends 34 of adjacent rods in a relatively tight, slide-in, end-to-end abutment. Other cross-sectional shapes are also feasible. Because of the sliding engagement, it is preferrable that both the sleeves and rods be relatively straight, at least at their respective end portions where they mate. This is especially true for rods or members containing curved portions, such as a circular ring frame.

The preferred connector sleeve 40 further includes a pair of detents 44 pierced or punched into its walls and spaced inwardly from respective ones of its ends. The detents are adapted to receive corresponding, laterally-extending tongues 46 formed on the rods 32 inwardly from their ends 34 in an over-center, locking engagement, and serve to hold the ends of the rods together in the connector sleeves.

The locking tongue 46 can be formed on the rods 32 in a variety of ways, but a method which results in a one-piece construction for the rod and a smooth, cam-like configuration for the tongue is preferred. This comprises placing the rod between the ends of a pair of cylindrical dies displaced inwardly from the rod's end 34 and laterally offset from its centerline and bringing the dies forcefully together to "pinch" or upset forge the tongue on the side of the rod.

The sleeves 40 can be formed from flat sheet stock, e.g., brass or mild steel, then rolled and/or heat-treated to achieve the desired shape and spring qualities, or alternatively, they can be fabricated from tubing of suitable material. In either case, appropriate and relatively inexpensive tooling can insure a product having a finished, quality look. Both the rods 32 and the sleeves 40 can be finished decoratively after fabrication by a wide variety of processes, such as plating or painting.

Figure 6:
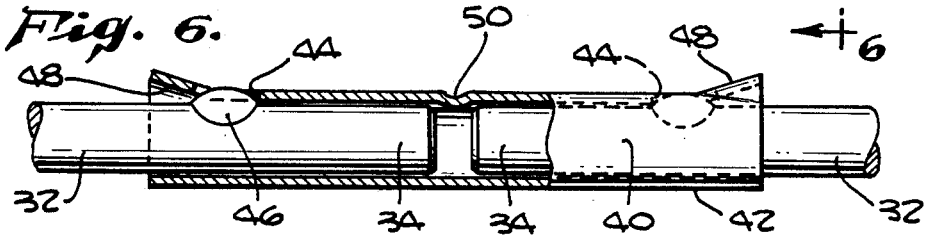
FIG. 6 is a side, partial sectional view of the connector illustrated in FIG. 5, as revealed by the section 6—6 taken therein.

As illustrated in FIGS. 5 and 6, the sleeve connector 40 may additionally incorporate a pair of swaged guide ramps 48 to initially align the tongues 46 and guide them into their respective locking detents 44, as well a dimple 50 disposed at about the middle of the sleeve, which serves as an end-stop for the rods 32 during their insertion into the sleeve.

Figure 7:
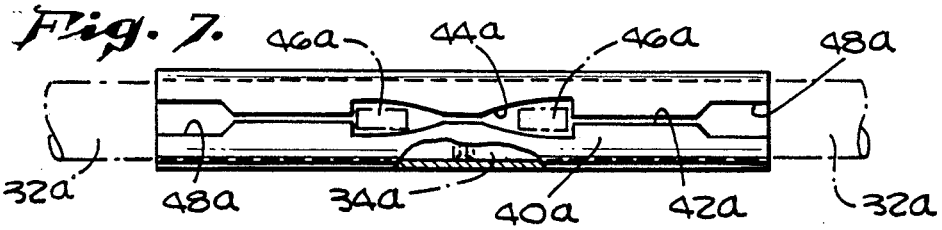
FIG. 7 is a plan view of an alternative embodiment of the connector illustrated in FIG. 5.
Figure 8:
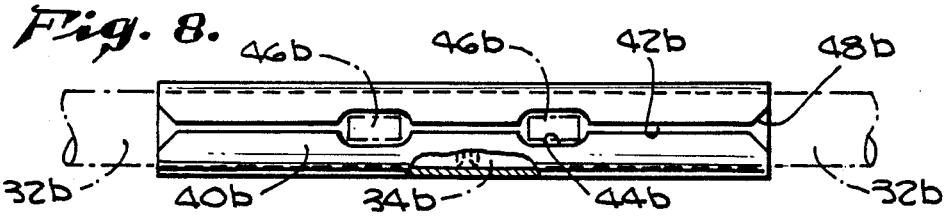
FIG. 8 is a plan view of another alternative embodiment of the connector illustrated in FIG. 5.

Two alternative preferred embodiments of connector sleeves **40*a* and 40*b* are illustrated in FIGS. 7 and 8, respectively, wherein features like or similar to those in the embodiment illustrated in FIG. 6 are numbered similarly, but with an "a" or "b" appended thereafter, as the case may be. The major distinction between these alternative embodiments and that in FIG. 6 is the location of the seam 42. In the sleeve 40, the seam is disposed on the side of the sleeve opposite to the locking detents 44 and the guide ramps 48, whereas, in the sleeves 40*a* and 40*b*, the seam centrally intersects these features or their equivalents. This latter placement of the seam permits it to be used as a guide channel which is spread apart by the tongue 46 during insertion of a corresponding rod end into the sleeve, and afterward, to snap back together behind the tongue to lock it in place. This latter operation is facilitated by the placement of tapered notches 48*a* or 48*b* at the entrance to the seam in lieu of the ramps 48 shown in the sleeve in FIGS. 5 and 6**.

As indicated above, it is possible to provide the ring frame 30 of the present invention in a number of polyagonal shapes, depending on the type of shade the ring is to be used with. Examples of a triangular, square, pentagonal, octagonal and circular ring frame are illustrated in FIGS. 9–13, respectively. Some of these alternative embodiments are illustrated to include only two rods, whereas others include three or more. As stated above, the breakdown is optional, but it is preferable that all the rods and the connectors be identical, as nearly as possible. In general, all that has been said hereinabove with respect to the materials, fabrication and assembly of the hexagonal embodiment illustrated in FIG. 4 applies to these embodiments as well.

Indeed, as will be observed, many possible modifications in terms of materials, construction and assembly are possible with the ring frame of the present invention. Accordingly, the embodiments illustrated and discussed herein should be taken as exemplary in nature, and the scope of the present invention limited only by the claims appended hereafter.

What is claimed is:

1. A knockdown ring frame for a lamp shade, comprising:

at least two rigid, elongated rods, each having opposite ends and formed to lie in a common plane and rigidly interconnect end-to-end to form a closed, planar ring, each said rod having a straight portion at each said end, each said portion having a transversely-extending tang formed thereon and spaced inwardly from a respective end; and at least two connector sleeves, each having open, opposite ends and a straight segment at each said open end adapted to slidably receive an end of one of said rods coaxially therein, each said segment having a detent therein spaced inwardly from a respective end of said sleeve adapted to receive one of said tangs in locking, over-center engagement.

2. The ring frame of claim 1, wherein said ring is an equilateral polygon.

3. The ring frame of claim 1, wherein said ring is generally circular.

4. A knockdown ring frame for a lamp shade, comprising:

a plurality of identical, rigid rods, each containing at least one bend and disposed end-to-end in a common plane to form an equilateral polygon;

a plurality of elongated, tubular connector clips for rigidly conecting adjacent ends of adjacent one of said rods together, each said rod having a pair of opposite, open ends and a straight portion adjacent each said open end sized internally to receive an end of one of said rods therein in a sliding, coaxial fit; and means for locking said ends of said rods within said clips.

5. The ring frame of claim 4, wherein said means for locking ends of said rods in said clips further comprise:

each said clip having an aperture extending transversely through a wall of each said straight portion and spaced inwardly from a respective end; and a pair of laterally-extending tongues formed on each said rod and disposed, one adjacent each said end thereof, to be received in locking engagement within corresponding ones of said apertures when said rod ends are inserted coaxially into said clips.

6. The ring frame of claim 5, wherein said apertures are in each longitudinal alignment in said clip, and wherein each said clip further contains a longitudinal slit extending throughout its length and passing through said apertures at about their centers.

7. The ring frame of claim 4, wherein each said clip further includes a rod-end stop extending transversely inward at about the midpoint of said clip.

8. The ring frame of claim 4, wherein said open ends of said clips each further include a longitudinally-extending guide ramp swaged thereinto in alignment with a corresponding one of said locking apertures to facilitate entry of an associated tongue into engagement with said aperture during assembly of said frame.

9. An improved snaptogether shade assembly for a lighting fixture of the type which includes a base part, a plurality of elongated ribs extending radially outward and downward from slots in said base, a plurality of trapezoidal windows supported by and between adjacent ones of said ribs, and at least one polygonal ring frame supporting said ribs in a radial direction, wherein the improvement comprises:

a knockdown, snaptogether ring frame assembly comprising:

a plurality of rigid, bent, elongated members, each having a pair of opposite ends and being assemblable end-to-end in a plane to form a closed, regular polygon, each said member having a cylindrical cross-section, a straight portion at each said end, and a locking tongue extending laterally from each said portion inwardly of a respective end; and a plurality of cylindrical connector sleeves, each having a pair of open ends for slidably receiving respective ones of adjacent ends of said members in opposing abutment and a pair of detents extending transversely through a wall of said sleeve inwardly of said open ends for receiving respective ones of said tongues in a locking, over-center type of engagement.

10. The shade assembly of claim 9, wherein each said sleeve is split longitudinally along one side for lateral expansion, and further includes an inwardly-directed end-stop for said members disposed at about its middle.

11. The shade assembly of claim 9, wherein each said sleeve further includes a longitudinally-extending guide ramp formed into each said open end thereof and adapted to receive and guide a corresponding locking tongue into a corresponding detent during insertion of an end of a member into said sleeve.

12. The shade assembly of claim 9, wherein said ring frame is hexagonal.

* * * * *